US007676850B2

(12) United States Patent
Steel

(10) Patent No.: US 7,676,850 B2
(45) Date of Patent: Mar. 16, 2010

(54) TOE SPACER SOCK AND CORRECTIVE FOOTWEAR

(76) Inventor: Michael M. Steel, P.O. Box 125, La Jolla, CA (US) 92038

( * ) Notice: Subject to any disclaimer, the term of this patent is extended or adjusted under 35 U.S.C. 154(b) by 837 days.

(21) Appl. No.: 11/395,522

(22) Filed: Apr. 3, 2006

(65) Prior Publication Data

US 2007/0074334 A1 Apr. 5, 2007

Related U.S. Application Data

(60) Provisional application No. 60/667,396, filed on Apr. 1, 2005.

(51) Int. Cl.
*A41B 11/00* (2006.01)
*A43B 17/00* (2006.01)

(52) U.S. Cl. ..... 2/239; 2/240

(58) Field of Classification Search ..... 602/30, 602/75, 76, 77, 78, 79; 2/239, 240, 241, 2/242, 22; 36/95; 128/893, 868, 880, 882; 606/201

See application file for complete search history.

(56) References Cited

U.S. PATENT DOCUMENTS

| | | | | |
|---|---|---|---|---|
| 1,175,718 | A | | 3/1916 | Crowe |
| 1,580,170 | A | | 4/1926 | Scholl |
| 1,746,865 | A | | 2/1930 | Page |
| 2,261,041 | A | | 10/1941 | Tennant |
| 2,416,823 | A | | 3/1947 | Day |
| 2,958,324 | A | | 11/1960 | Berkemann |
| 3,049,120 | A | | 8/1962 | Marcus |
| 3,086,523 | A | | 4/1963 | Lowth |
| 3,128,763 | A | | 4/1964 | Langenfield et al. |
| 3,299,894 | A | | 1/1967 | Charlebois |
| 4,414,964 | A | | 11/1983 | Farino et al. |
| 4,583,303 | A | | 4/1986 | Laiacona et al. |
| 4,745,927 | A | | 5/1988 | Brock |
| 4,819,644 | A | | 4/1989 | Cherniak |
| 4,856,505 | A | | 8/1989 | Shaffer et al. |
| 4,940,046 | A | | 7/1990 | Jacoby |
| 5,282,782 | A | | 2/1994 | Kasahara |
| 5,437,616 | A | | 8/1995 | Kasahara |
| 5,453,083 | A | | 9/1995 | Kasahara |
| 5,772,621 | A | * | 6/1998 | Unruh ..... 602/30 |
| 5,928,173 | A | * | 7/1999 | Unruh ..... 602/30 |
| 6,093,163 | A | | 7/2000 | Chong et al. |
| 6,315,749 | B1 | | 11/2001 | Sunayama |
| 6,318,373 | B1 | | 11/2001 | Kasahara |
| 6,629,943 | B1 | | 10/2003 | Schroder |

* cited by examiner

*Primary Examiner*—Gary L Welch
*Assistant Examiner*—Amber R Anderson
(74) *Attorney, Agent, or Firm*—Shoemaker and Mattare

(57) ABSTRACT

A sock contains built-in cushions or spacers to correct or protect the toes, or to provide the wearer better comfort. The cushions or spacers may be retained between the toes in a tube, formed integrally with the sock, which is everted to a position between adjacent toes. A strap may also be built in to the sock, or into a shoe, shoe insert, boot, sandal or slipper to maintain a corrective force on the great toe.

1 Claim, 14 Drawing Sheets

TOE SPACER SOCK AND CORRECTIVE FOOTWEAR

This application claims benefit of provisional patent application 60/667396, filed Apr. 1, 2005.

BACKGROUND OF THE INVENTION

This invention relates to orthopedic footwear, and more particularly to a sock having extended, reversible tubes or fingers formed thereon for retaining toe separators or cushions between the toes.

The invention is concerned with proper alignment of the big toe (Hallux). In some people, there is a tendency of the big toe to bend outward (Valgus) toward the smaller toes and deform over time into a Hallux Valgus or crooked big toe. The cause may be hereditary, or it can be the extended wearing of shoes that are too tight or ill fitting. Beyond being unsightly, a bent great toe can turn so dramatically to the outside of the foot that the bursa at the base of the big toe becomes inflamed and swells (bunion). In addition, the big toe can interfere with, irritate and deform the adjacent smaller toes. The resulting deformity of the toe bones and joints (Hallus Vagus) can be so painful that corrective surgery is commonly required. It is the purpose of this invention to reduce substantially the frequency of such surgeries through the protective and corrective forces that this invention will provide to crooked and healthy toes.

Prior inventors have developed a number of solutions for correcting the toes, by providing splints, separators and the like. Many such devices are needlessly complex and difficult to apply and wear. It would benefit those suffering from certain foot problems to have a simple sock construction specially designed to retain toe spacers or cushions.

SUMMARY OF THE INVENTION

An object of the invention is to provide a sock that supports cushions or separators or toes straps between or around at least two toes of the foot, to protect or correct the toes.

Another object is to maintain a corrective force on the big toe, with the aim of straightening the toe, or preventing it from becoming more crooked.

These and other objects are attained by the socks shown in the drawings and described below.

In the following description, the term "toe sock" means a sock constructed so that the five toes of the foot (designated T1-T5, beginning with the great toe) are individually surrounded by sock fabric, so that each toe can move independently. The term "great toe" means the big toe. The term "tabi sock" means a sock knitted so that the large or great toe is surrounded by fabric, and the four smaller toes are contained together in one compartment, analogous to a mitten for the hand. Tabi socks are commonly worn with sandals. The sandal post slips into the space between the two toe compartments.

A primary advantage of the invention is its ease of use. The wearer simply puts on a sock the normal course of dressing and the cushion already properly positioned.

Another advantage of the invention is that enables one to insert cushions of different sizes. A person can then use a thinner or thicker cushion, according to their particular foot condition. Actually, the person can start with a thin cushion, and gradually increase the cushion thickness to increase corrective force without discomfort. In addition, the toe correcting straps can start with a light tension in the beginning and then be adjusted to increase the corrective force without discomfort.

BRIEF DESCRIPTION OF THE DRAWINGS

In the accompanying drawings.

DESCRIPTION OF THE PREFERRED EMBODIMENTS

Figure 1:
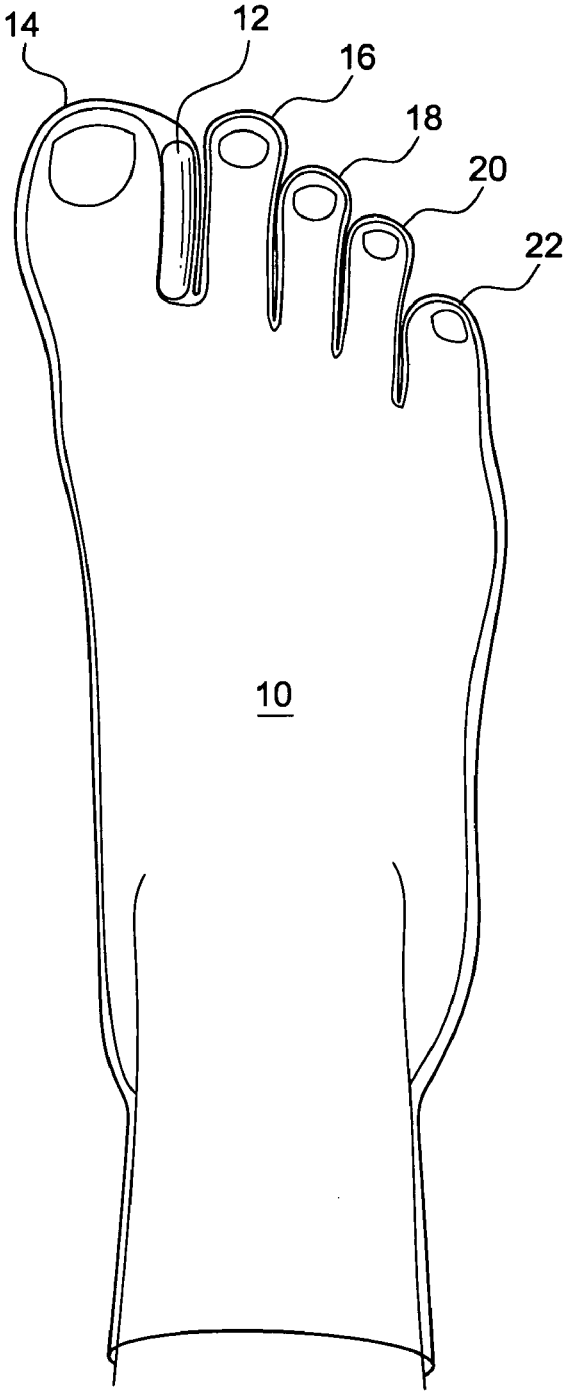
FIG. 1 is a top plan view of a toe separator sock, having individual toes, one toe containing an attached toe separator or a toe spacer to the right side of the great toe.
Figure 2:
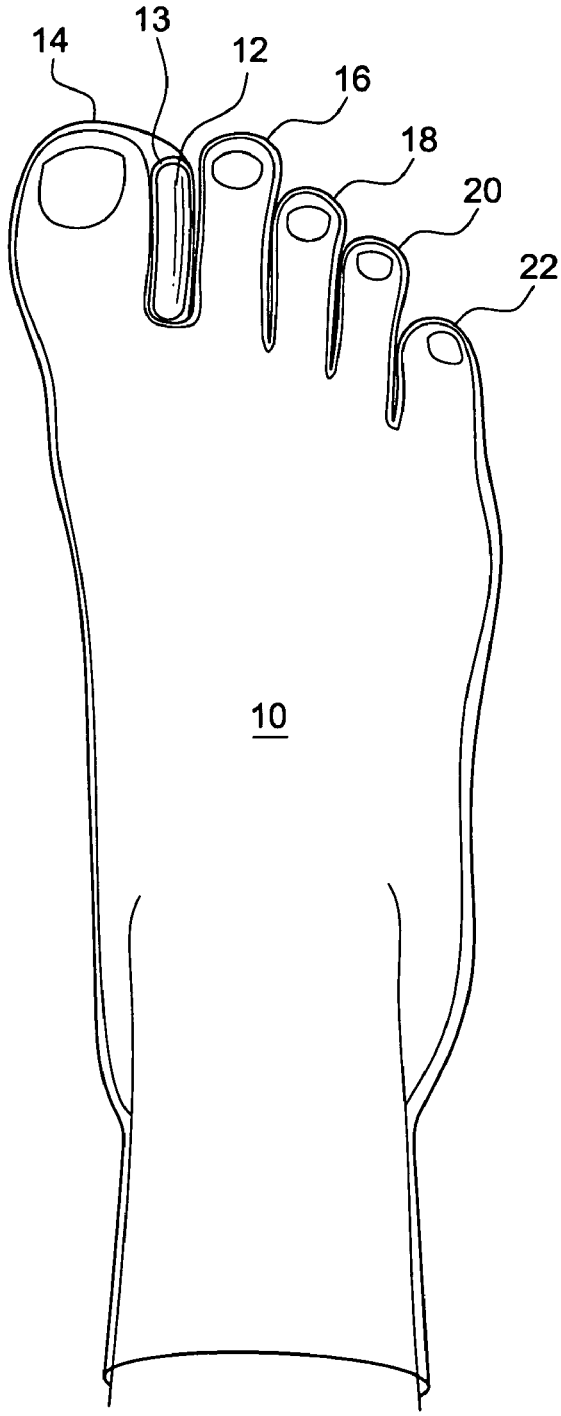
FIG. 2 is a top plan view of a modified form of the invention, showing the sock with a spacer inserted into a receptacle.

FIG. 1 show a toe sock 10 having individual toe compartments 14, 16, 18, 20, 22, with a cushion, spacer or toe separator 12 provided on the inside of the great toe compartment 15. In FIG. 2, the spacer or cushion 12 is situated in its own compartment 13.

Figure 3:
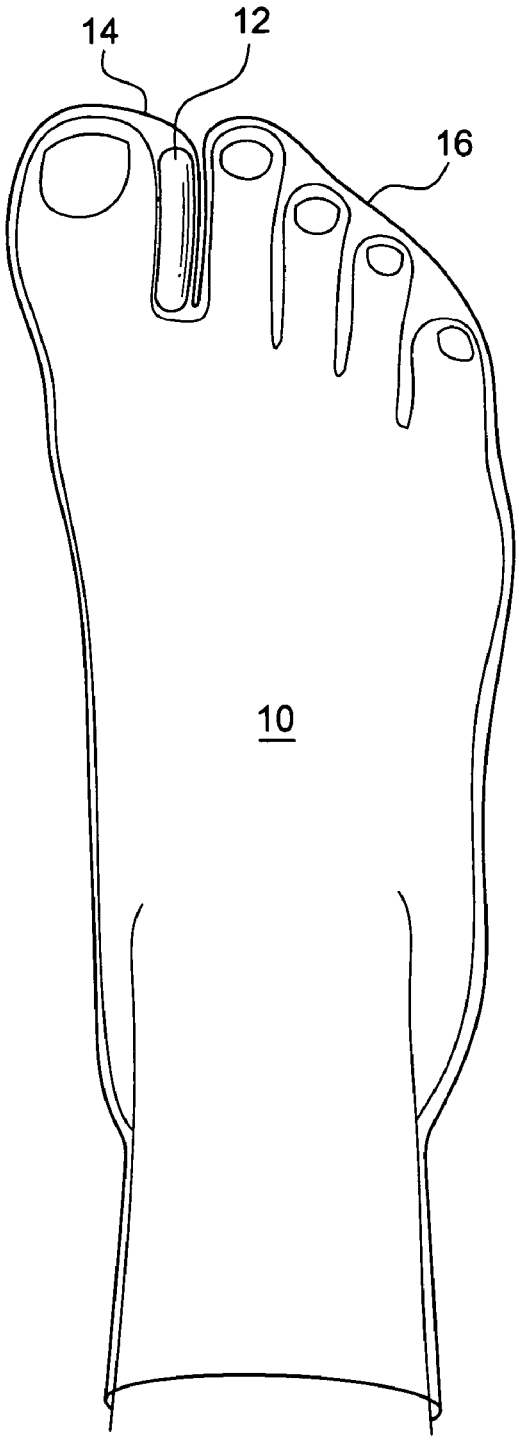
FIG. 3 is a top plan view of a modified form of the invention, wherein the four smaller toes are contained within a single sock space.
Figure 4:
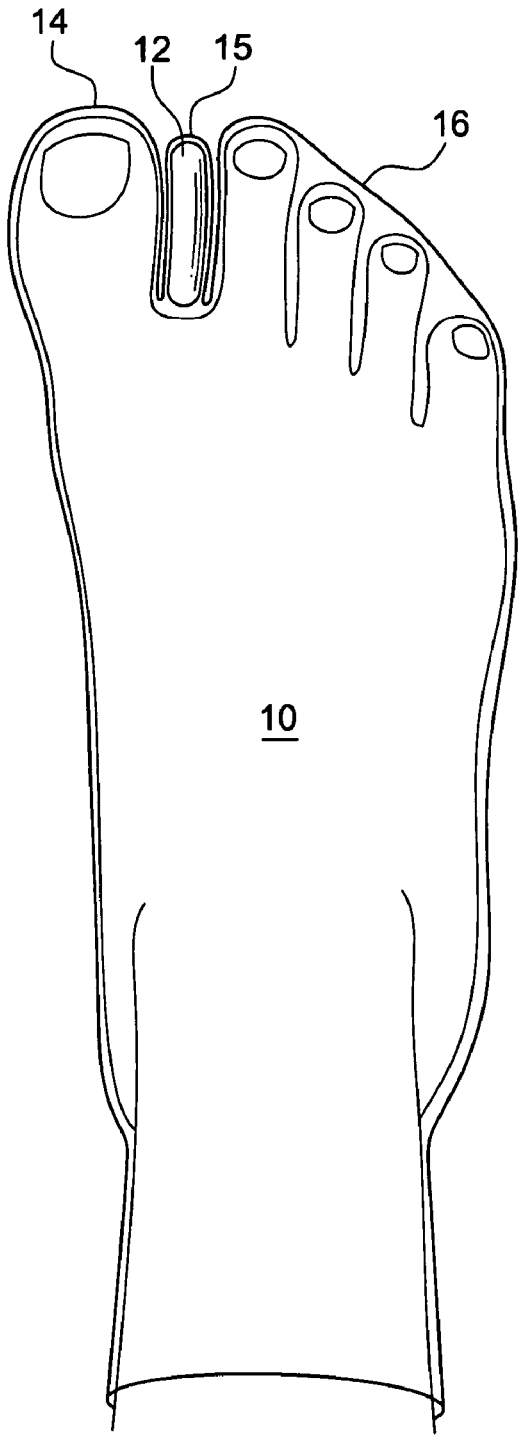
FIG. 4 shows another variation, in which the spacer receptacle is formed separately between two toes.
Figure 5:
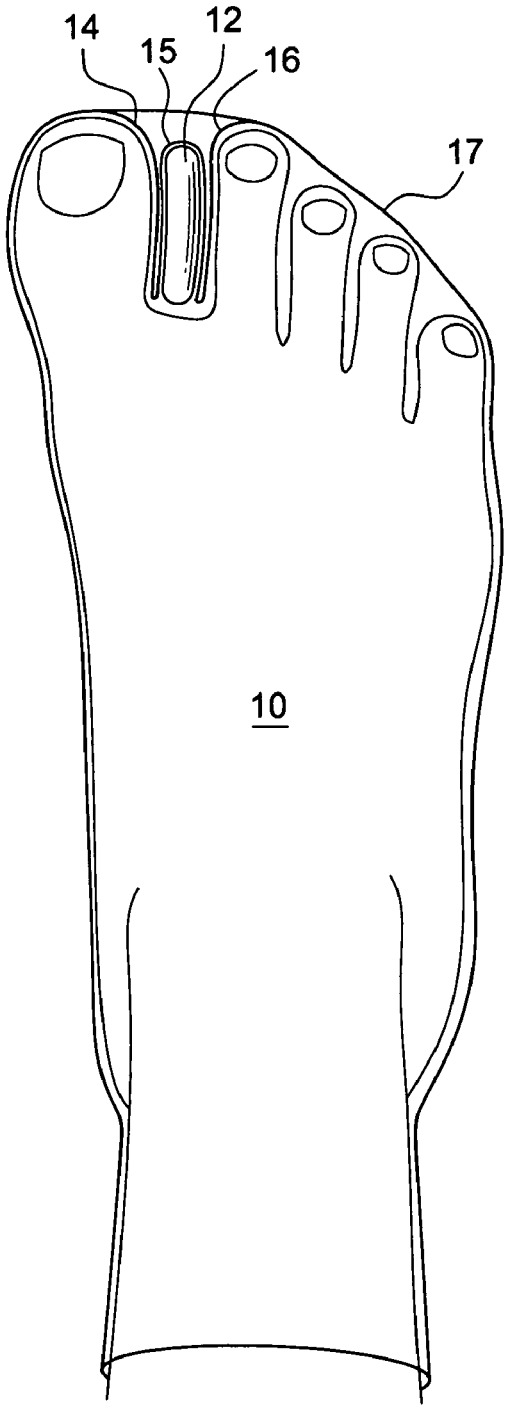
FIG. 5 is like FIG. 4, except that the sock encloses all the toes within its outer layer.
Figure 6:
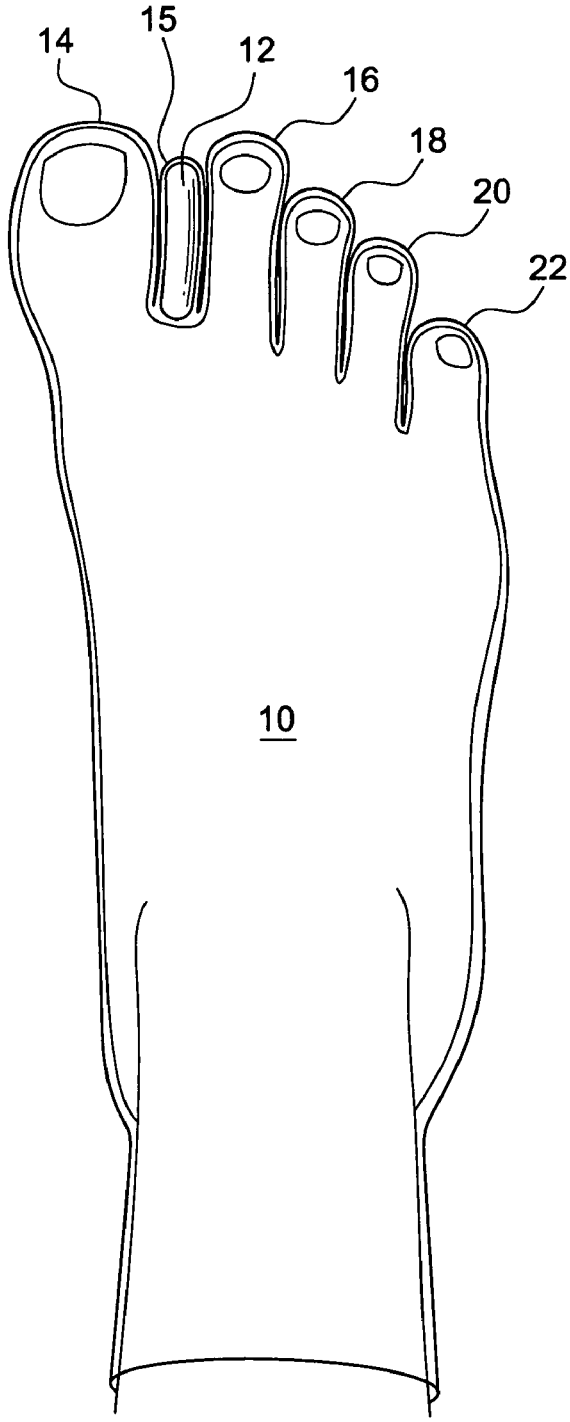
FIG. 6 is another modification, wherein all of the toes, and the spacer receptacle, are individually formed.
Figure 7:
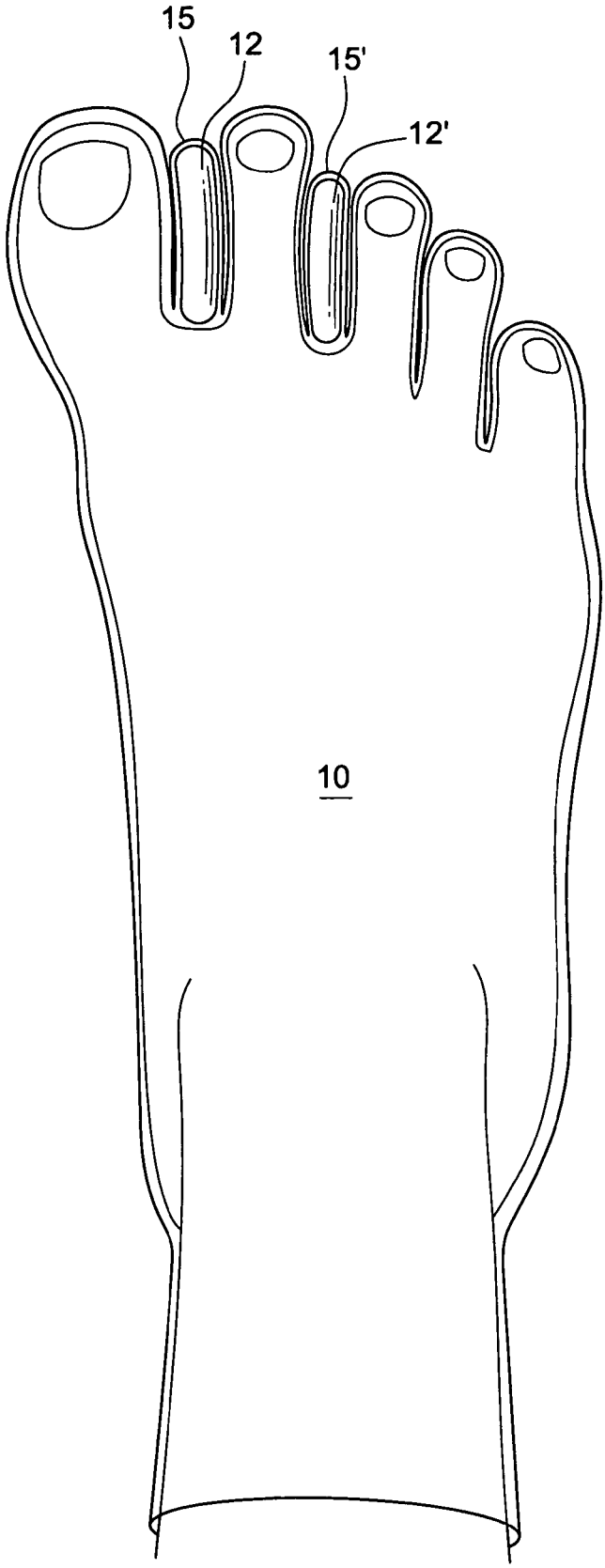
FIG. 7 illustrates another variation, in which the toes are individually formed, and there are two separator receptacles.

The sock shown in FIG. 3 is like that of FIG. 1, except the lesser toes are situated in a common compartment 16. FIG. 4 shows a variation in which the spacer 12 is contained in its own compartment 15 between the toe compartments 14, 16. FIG. 5 shows a variation of FIG. 4, where an outer layer of material has been added over the cushion to give the sock a conventional appearance. FIG. 6 is a version of FIG. 4, with individual toe compartments. FIG. 7 is like FIG. 6, with the addition of another spacer 12', in its own compartment 15' between the second and third toes.

Figure 8:
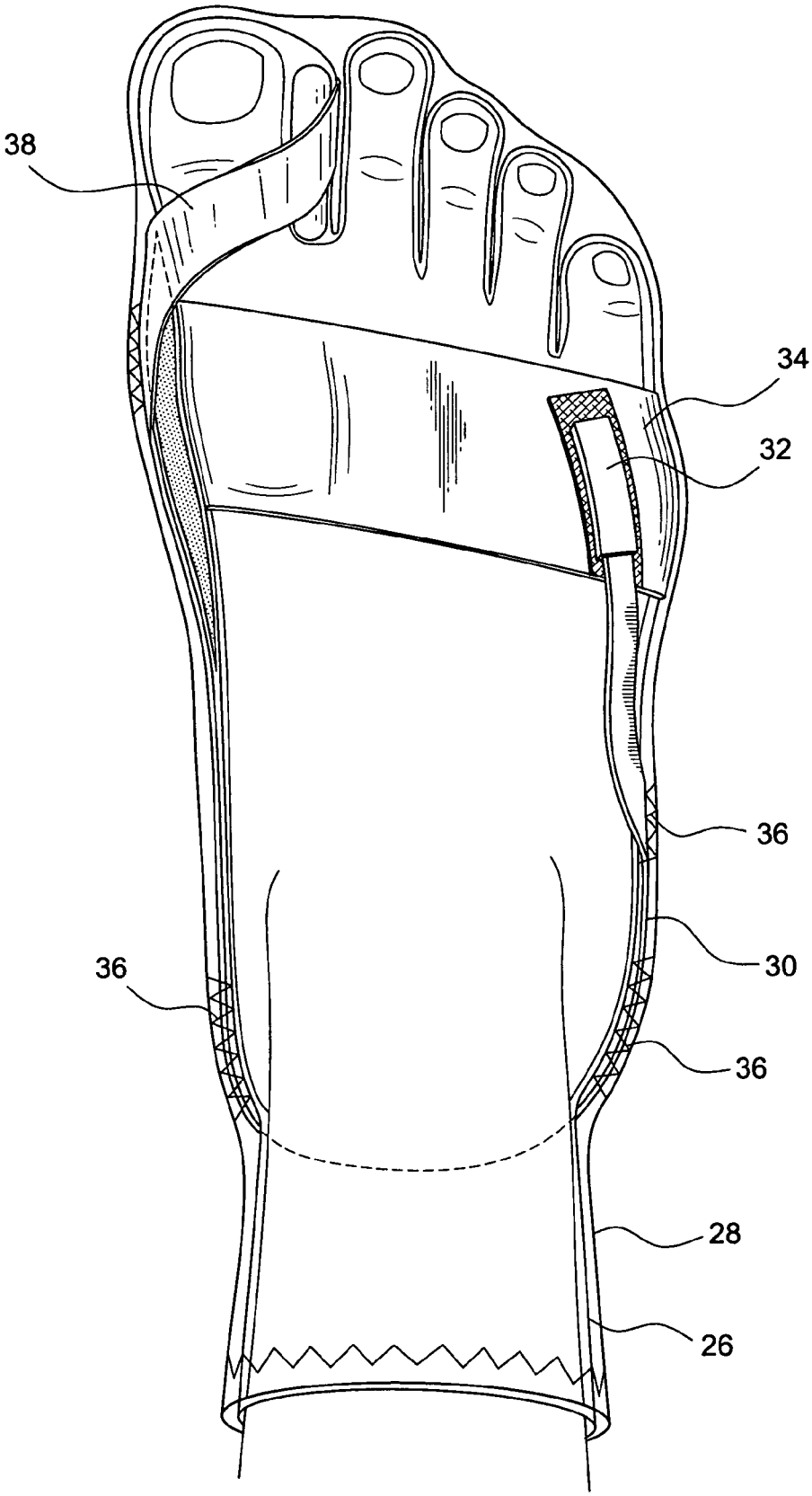
FIG. 8 shows another embodiment, including a strap and toe cap or hood which is looped over and around the great toe, and passes around the heel to an anchor point on the outside of the foot.

FIG. 8 shows a toe sock containing an elastic strap 30 having a reinforced loop 38 which is placed over and around the big toe. The strap is intended to prevent a big toe from deforming into a crooked bunion toe, or to correct a slightly bent one. The elastic strap 30 travels between inner and outer layers 26, 28 of the sock, through passages defined by stitching 36, along the inside edge of the foot, just below the ankle and around the heel, thence along the outside of the foot (just slightly on the top side of the foot). Its free end 32 attaches to the sock at an anchor spot 34 just before reaching the last two smaller toes. The end may have a hook-type Velcro element for engaging loops in the sock material. This sock may also be constructed with one single layer in which case the strap will be retained in its proper place by fabric channels or tunnels at 36.

Figure 9:
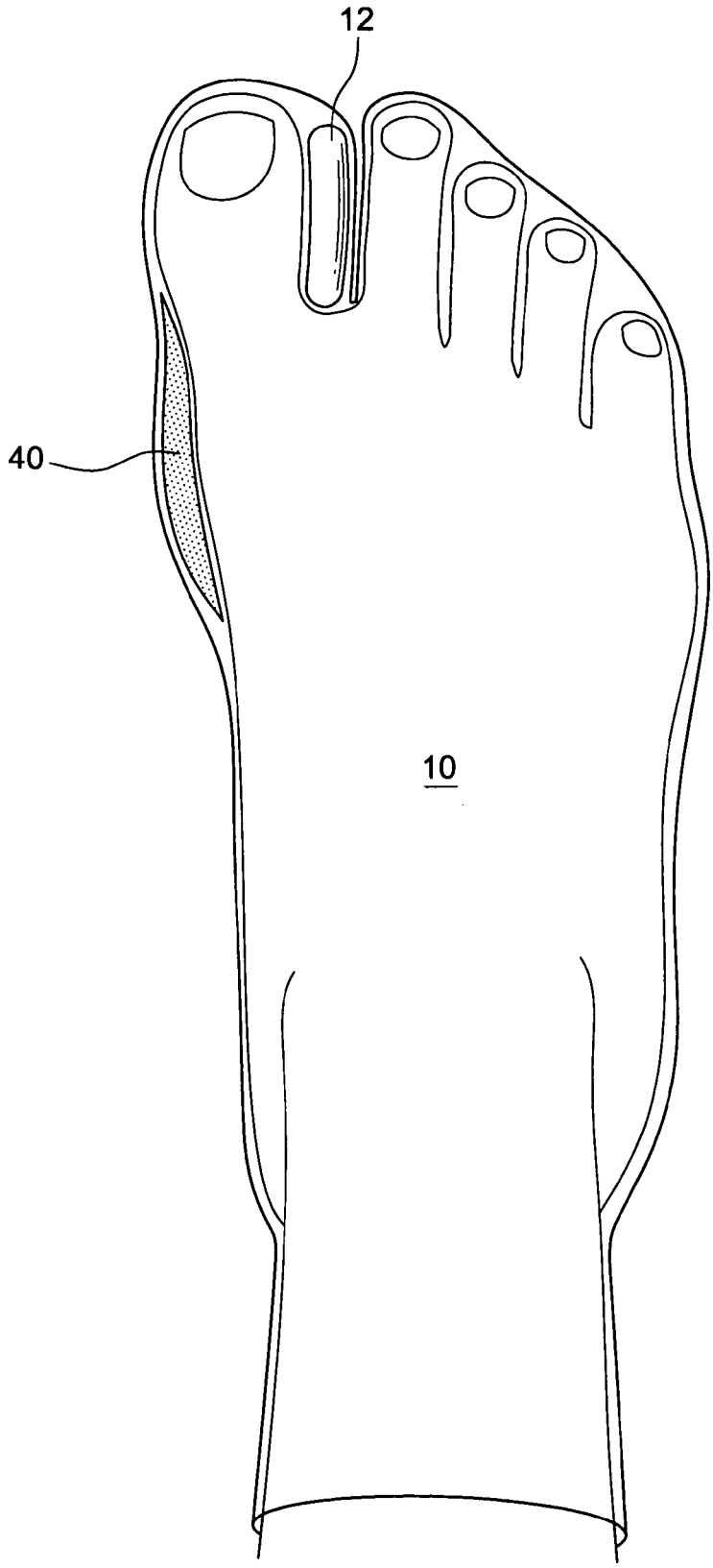
FIG. 9 is a top plan view of a sock like that of FIG. 1, with the addition of a bunion pad on the left side of the foot.
Figure 26:
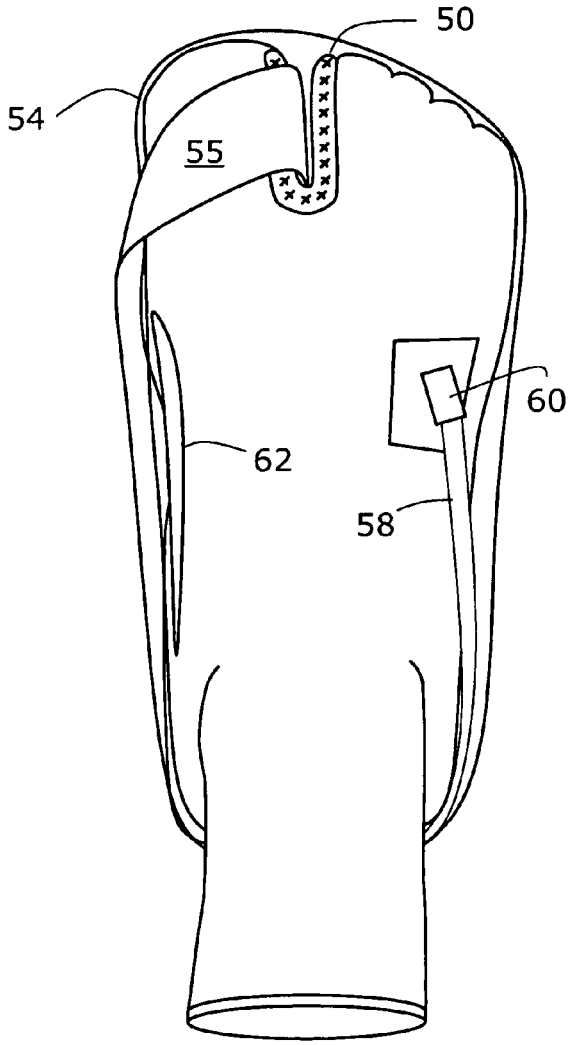
FIG. 26 shows a shoe, boot, sandal or slipper which, like the sock of FIG. 8, contains an adjustable strap for maintaining a corrective force on the great toe.

As shown in FIG. 9, any of the socks having built-in toe spacers, toe separators or toe straps may also contain a bunion cushion 40 at the inner side of the ball of the foot to help relieve the pain and irritation of a toe bunion. As shown in FIG. 26, any of the socks having built-in toe spacers, toe separators or toe straps may also contain a foot spacer or a foot repositioning pad 62 at the inner side of the foot to reposition the foot toward the outside of the shoe. The cushion or pad repositions the foot away from the inside wall of the shoe, thus reducing pressure on the big toe, which can contribute to deformation of the great toe. The repositioning of the foot also allows the toe cushions, toe separators and toe straps to have greater mechanical leverage and increased corrective action on the toes.

Figure 10:
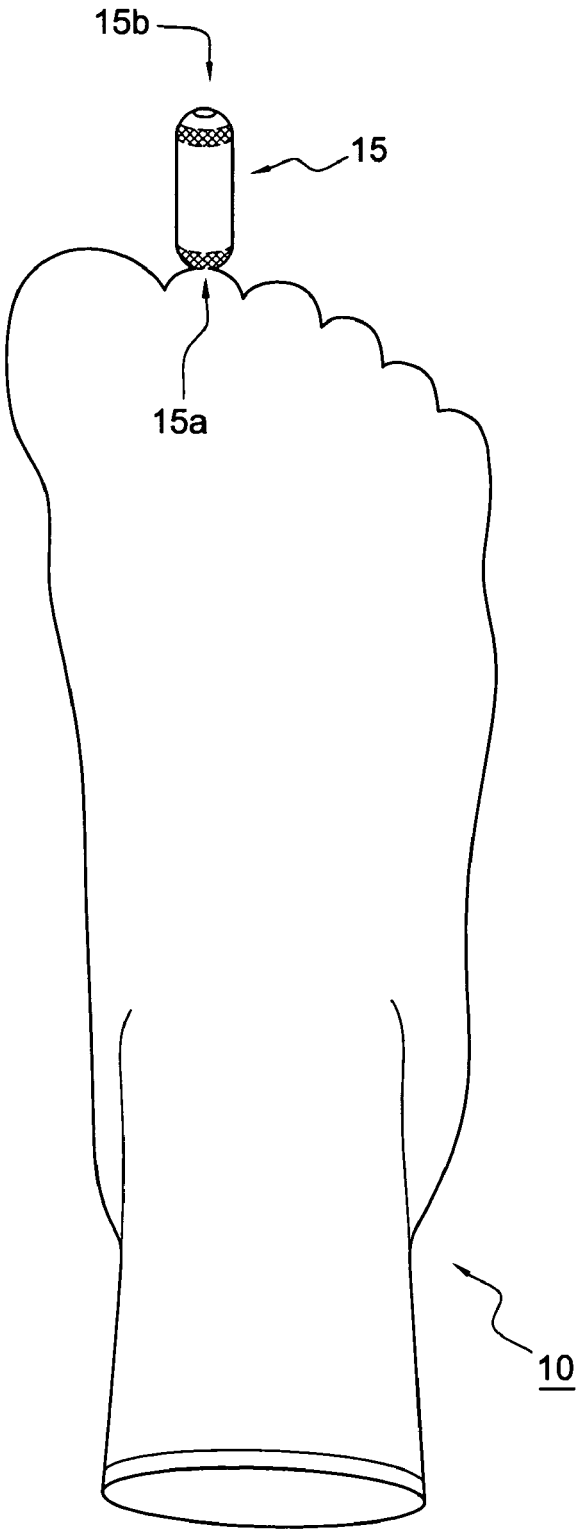
FIG. 10 is a top plan view of sock having a spacer tube or toe separator tube as manufactured, before the tube is inverted.

FIG. 10 shows a single-cushion toe sock as it emerges from the toe sock-knitting machine as shown FIG. 1. The sock has a non-conventional spacer pocket 15 in the form of a knit tube, about the length of a toe, extending forward from the toe. The pocket is connected to the sock by a neck of reduced diameter.

Figure 11:
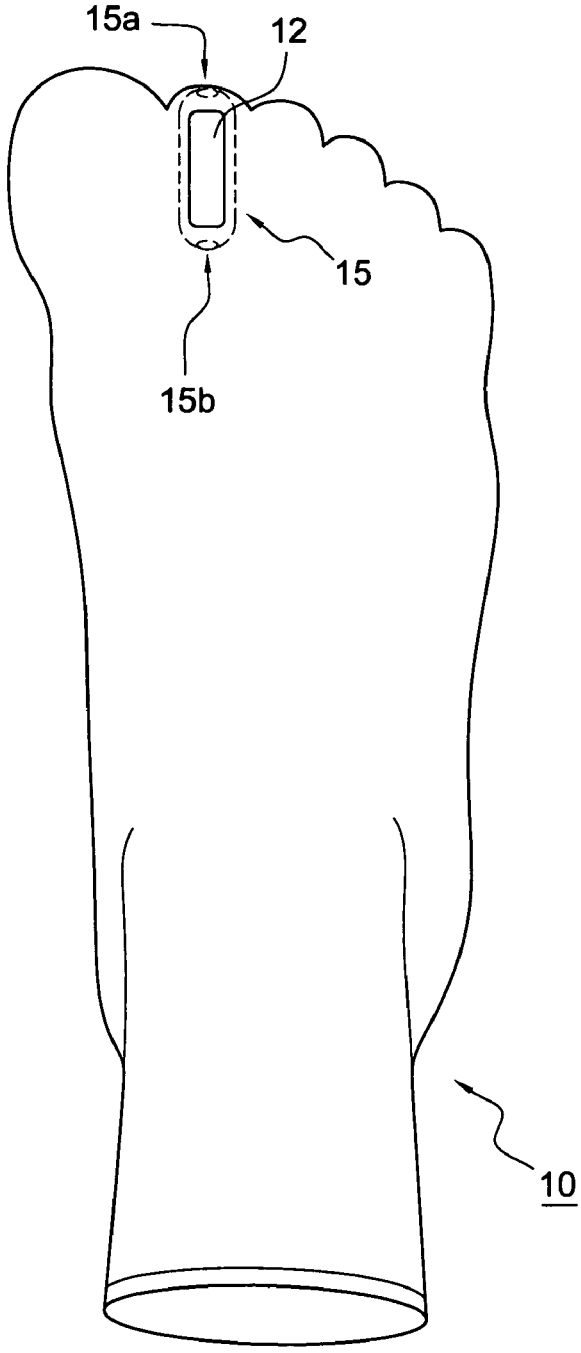
FIG. 11 shows the sock of FIG. 10, after the toe tube has been inverted.

FIG. 11 shows the sock, once the spacer pocket 15 has been everted by pushing it into the interior of the sock. Now a spacer or cushion may be inserted into the pocket. The reduced-diameter neck help keeps the pocket everted and inside the sock, but if desired, the spacer or cushion may be sewn, glued or otherwise attached to the sock fabric. The pocket may, optionally, have an open end 15*b*, so that the toe cushion may be removed from the inside and, if desired, replaced by a thinner or thicker toe spacer.

Figure 12:
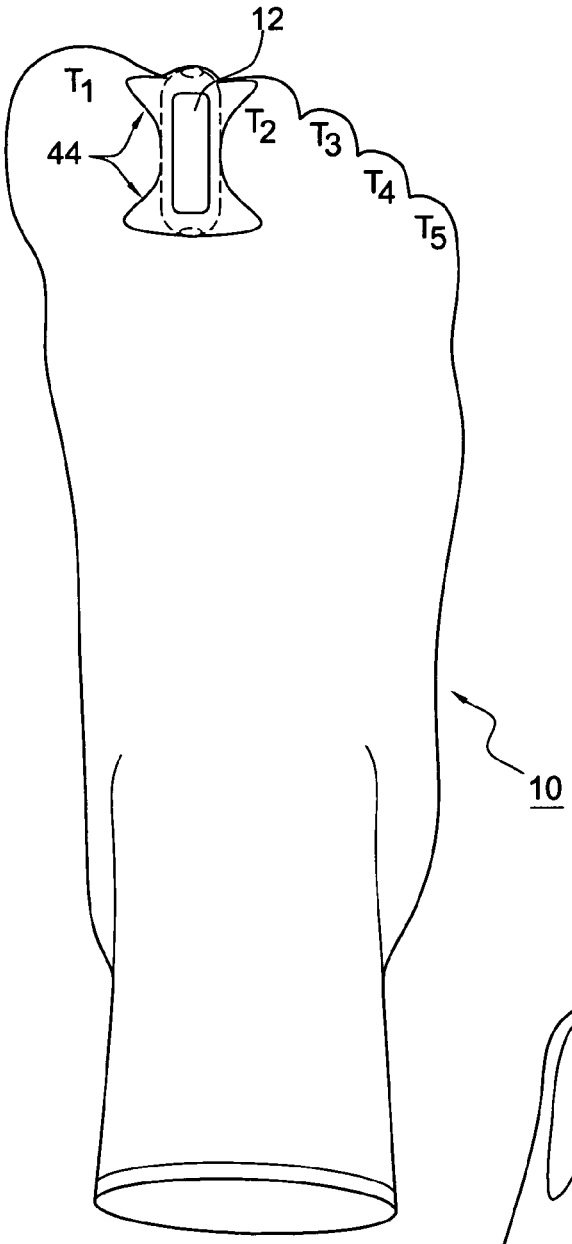
FIG. 12 is a modification of the sock of FIG. 11, containing an additional element.

To prevent the toe separator from becoming dislodged during strenuous exercise such as running, tennis or gymnastics, the sock illustrated in FIG. 12 has the toe spacer attached to a slightly larger under base which prevents the toe spacer from moving up between the toes or dislodging. The toe spacer compartment is more securely held in place by the added wings 44 (FIGS. 12 and 13), which are situated in the low pressure concave areas near the base of the toes and at the toe tips.

Figure 14:
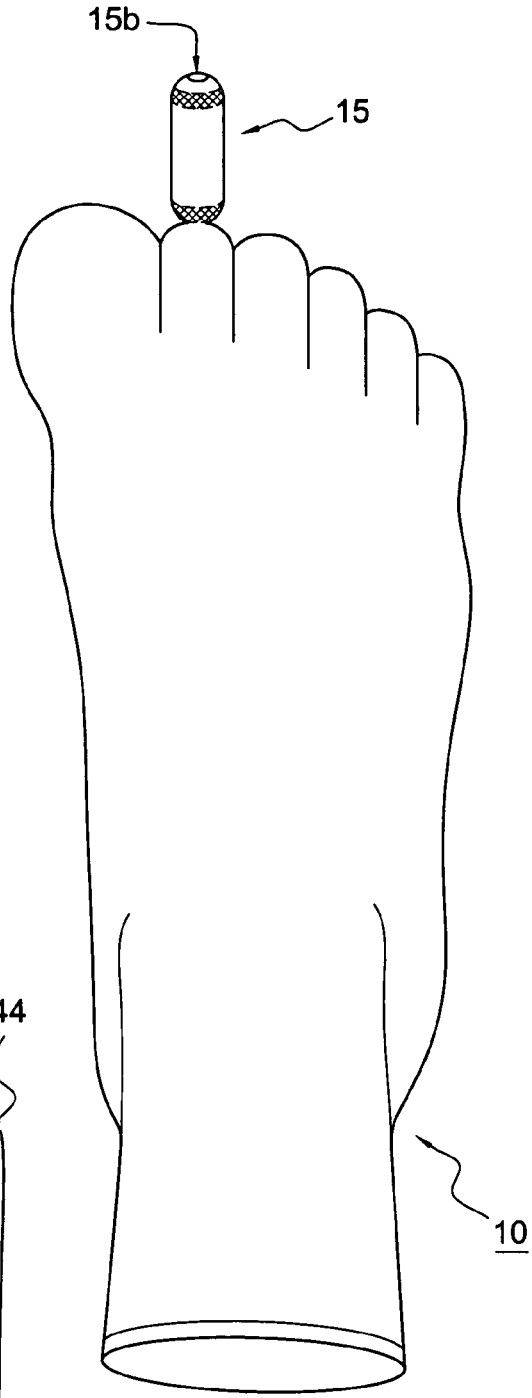
FIG. 14 is similar to FIG. 10, except that the toes have separate compartments which are one half conventional toe length.

The sock of FIG. 14 is identical to that of FIG. 10, except that individual toe compartments are formed to be one half the normal length fo the common toe sock. This irregular one-half toe length construction increases the air circulation around the toes of the foot, thereby reducing or preventing the incidence of toe fungus or athlete's foot. The top half of the toes are covered and separated by fabric, leaving the bottom half of the toes separated slightly and open for air circulation.

Figure 15:
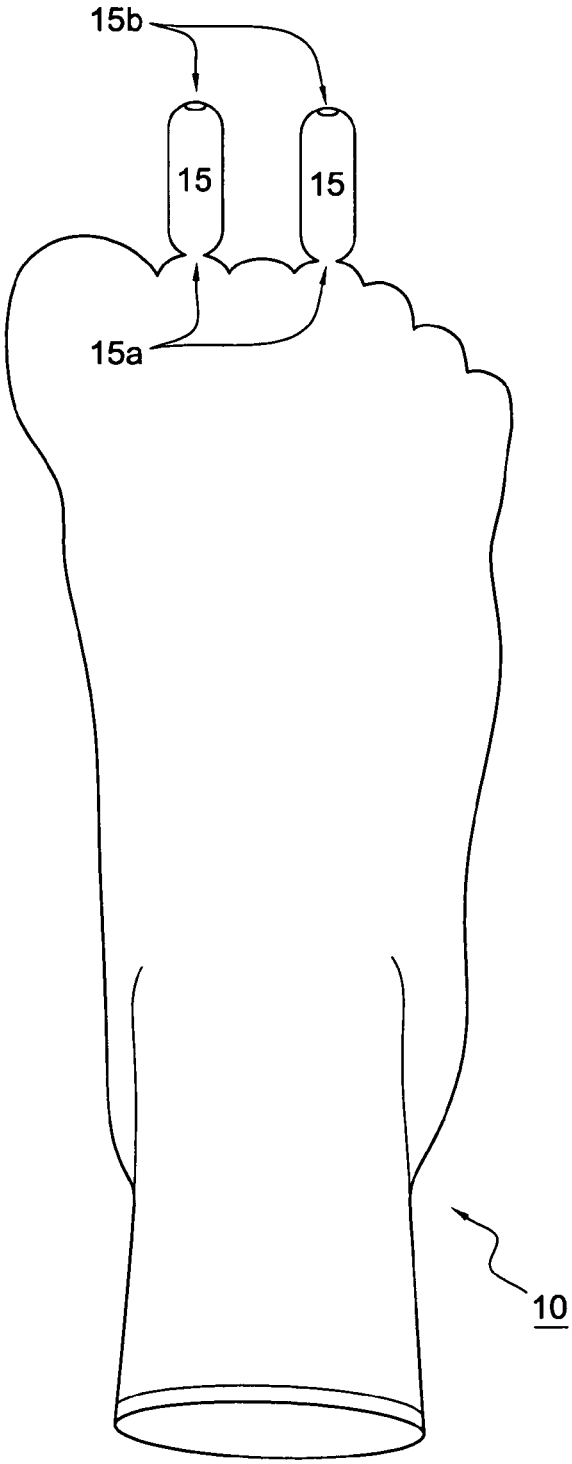
FIG. 15 is a plan view of a double toe tube sock, before inverting the two tubular cushion pockets.
Figure 16:
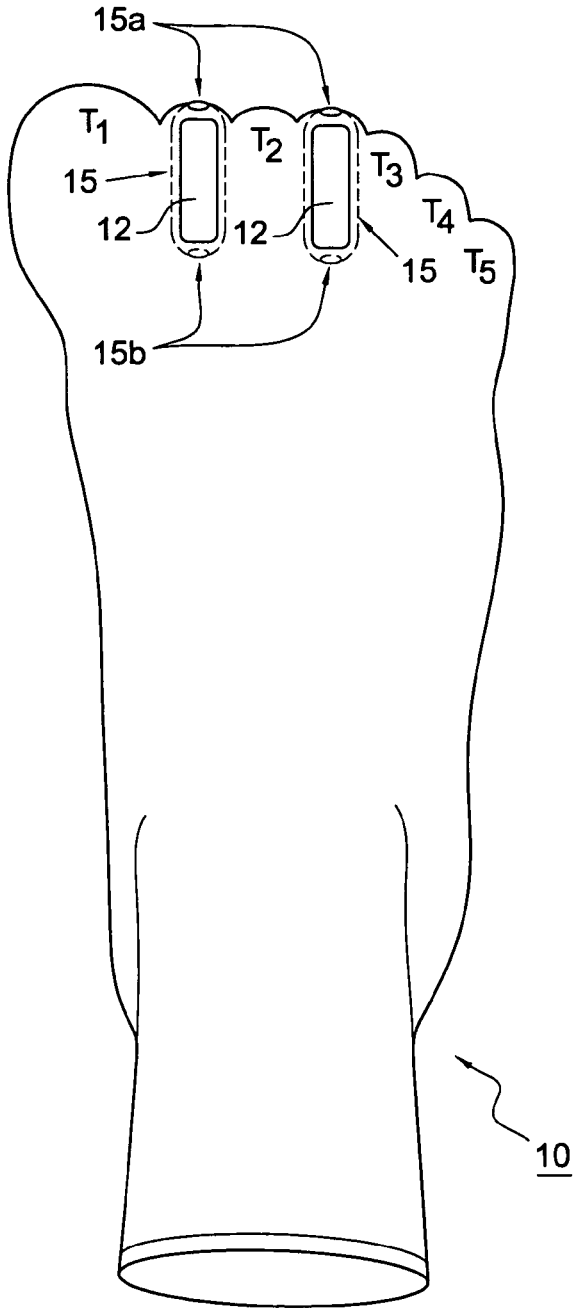
FIG. 16 is a top plan view thereof, after inverting the cushion pockets.
Figure 17:
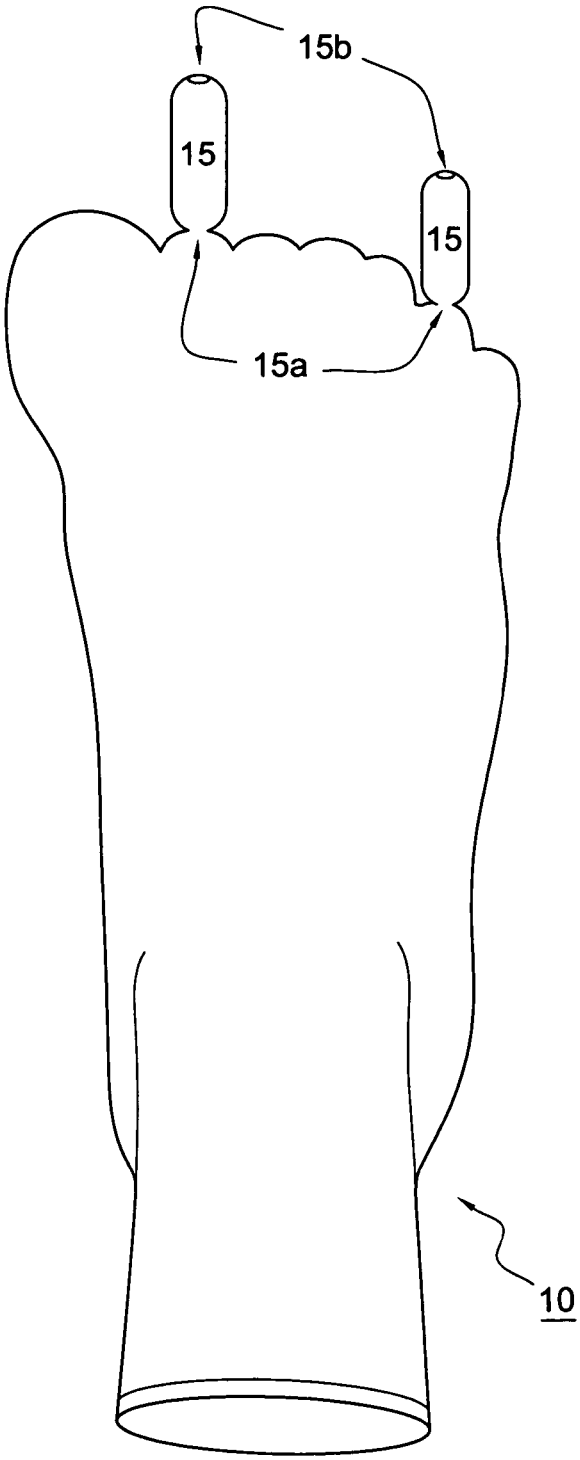
FIG. 17 is a plan view of another double toe tube sock, before inverting the two cushion pockets.
Figure 18:
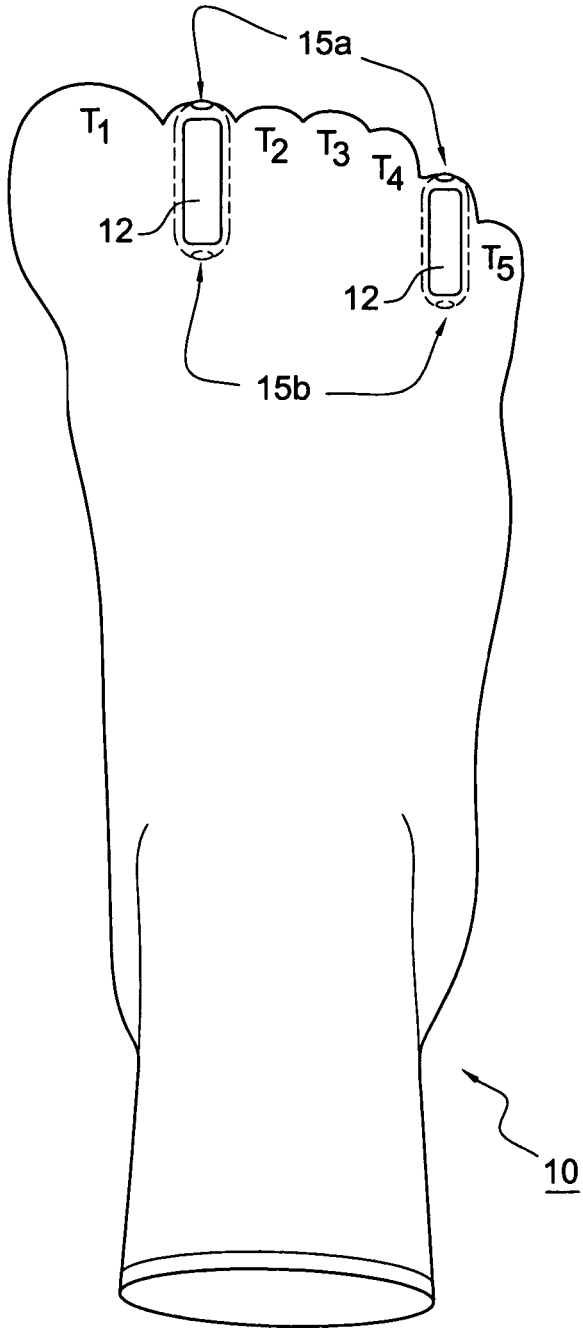
FIG. 18 is a top plan view thereof, after inverting the two cushion pockets.

The sock of FIG. 15 is similar to the single finger toe separator sock of FIG. 10, except it has two separate cushion pockets. The pocket sections are everted (FIG. 16) as described in the preceding paragraph. Spacers or cushions may be inserted into the everted pockets at this point, or subsequently, by the end user. FIGS. 17 and 18 show another variation, where spacers are placed between the first two toes and the last two toes.

Figure 19:
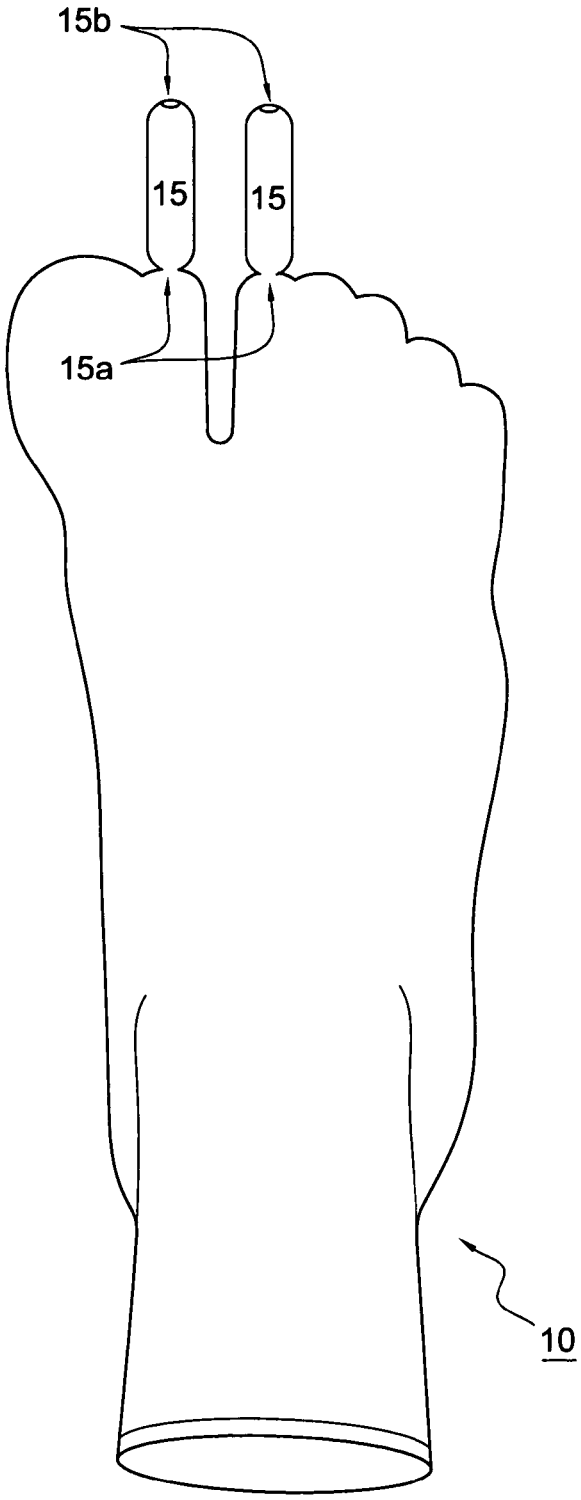
FIGS. 19 and 20 show a sock, suitable for wearing with thong-type sandals, in which there are separate compartments for the great toe, and for the remaining toes, and cushions pockets are provided on opposing sides of the compartments.
Figure 20:
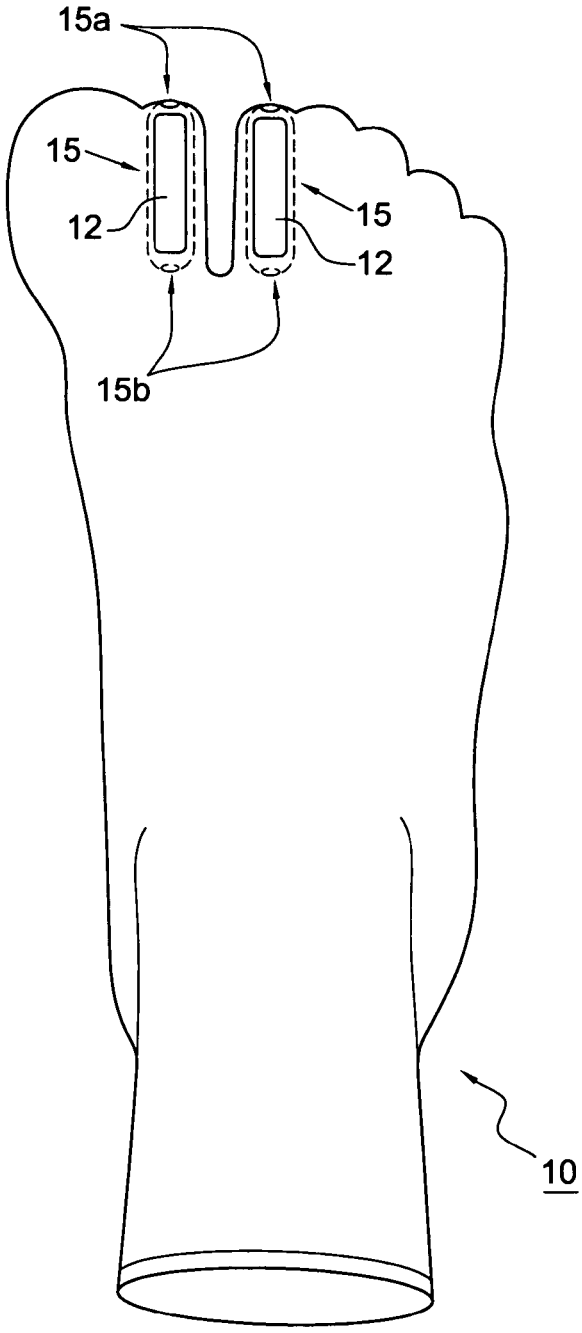

FIG. 19 illustrates a tabi sandal sock 10, having a groove or space between the great toe compartment and the lesser toes compartment. FIG. 20 shows the sock after the cushion pockets 15 have been pushed or inverted into the inside of the sock. The tabi sock reduces or eliminates irritation between the great and second toe by the sandal post as the wearer walks. This enables people having painful bunions to wear sandals comfortably.

Figure 21:
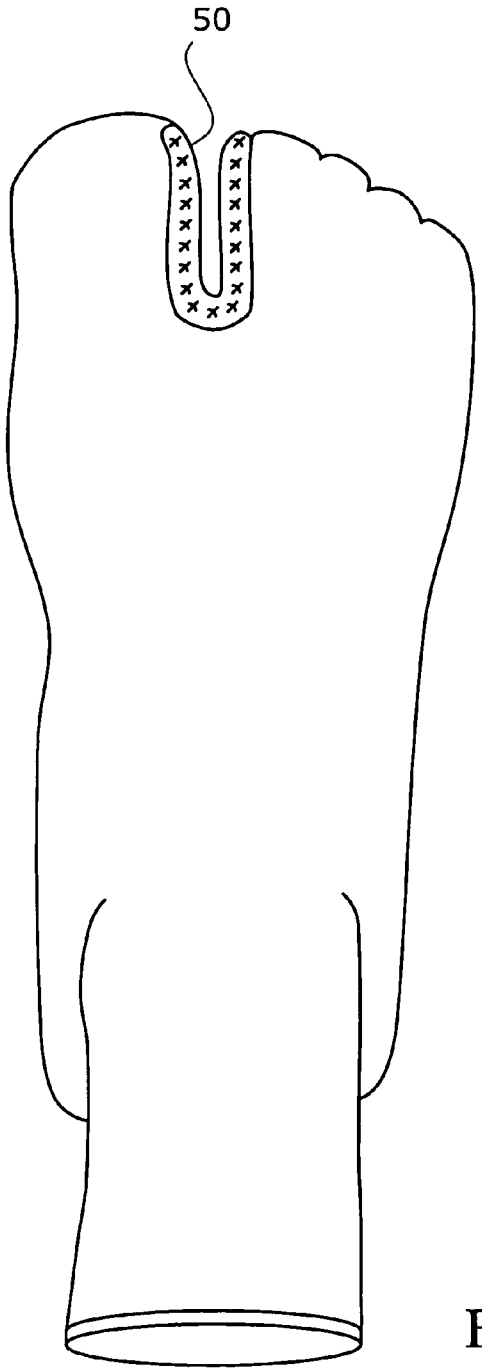
FIG. 21 illustrates a sock having a U-shaped cushion permanently sewn into the sock between the great and second toes.

FIG. 21 is a top plan view of a tabi sandal sock having a U-shaped cushion 50 permanently sewn into the "V" area between the toes. In this embodiment, there is no separate cushion compartment. The cushion may have a durable fabric covering or similar material integrated with a silicon gel or foam so that the sewing stitches do not pull through the cushion.

Figure 22:
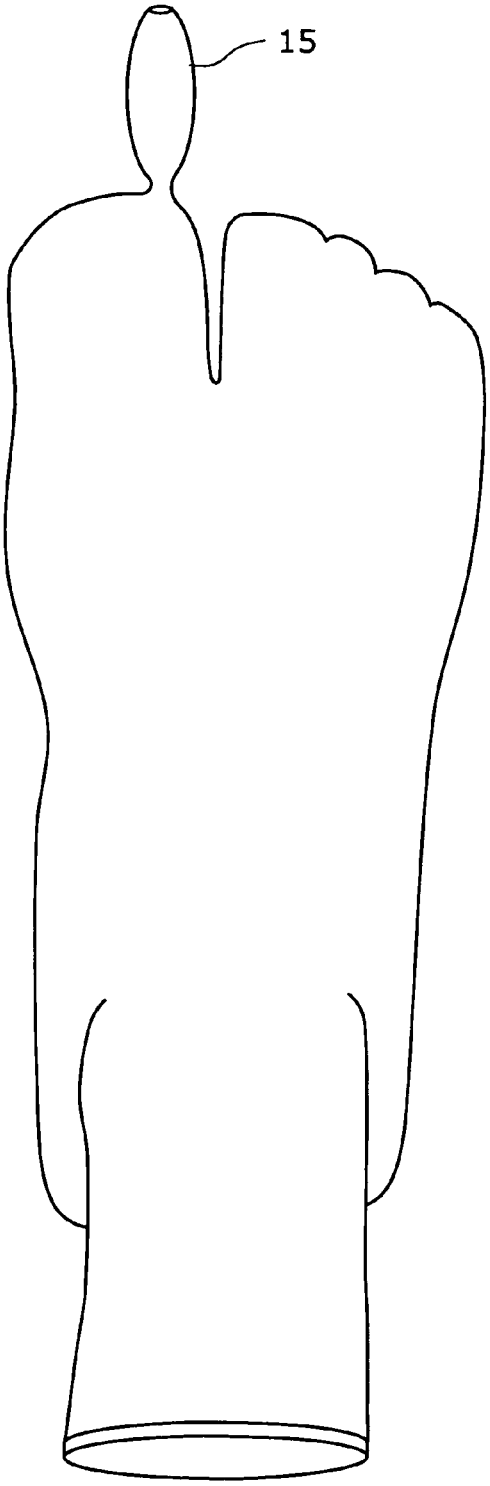
FIGS. 22 and 23 show an alternative to the sock of FIG. 19, wherein a cushion retainer tube is provided only on the great toe side compartment of the sock.
Figure 23:
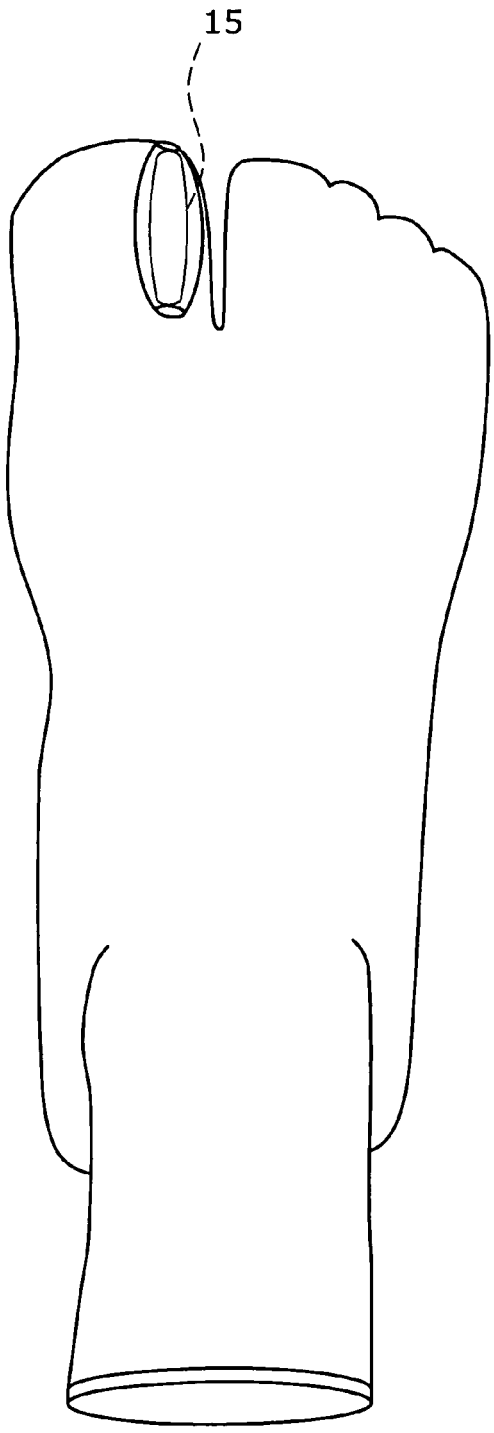

FIG. 22 shows a tabi sock having a single cushion pocket 15 extending from the great toe compartment. The pocket has been everted in FIG. 23.

Tabi socks knit without seams are particularly useful for application with a shoe, such as that shown in FIG. 26, having a strap built in for correcting a crooked big toe. A tabi sock is necessary in this application so that the big toe is isolated and can receive a loop or hood that is attached to an elastic strap which applies effective mechanical correcting pressure on the big toe. Building a toe separator or cushion into the sock helps reduce any discomfort on the inside of the big toe caused by the correcting force of the toe strap. The fabric stitching on the inside of the big toe can be manufactured by a programmable sock knitting machine in such a way as to have a loose knit area comprising yarn loops which can be used as an anchor for Velcro hook elements provided on the toe strap.

Figure 24:
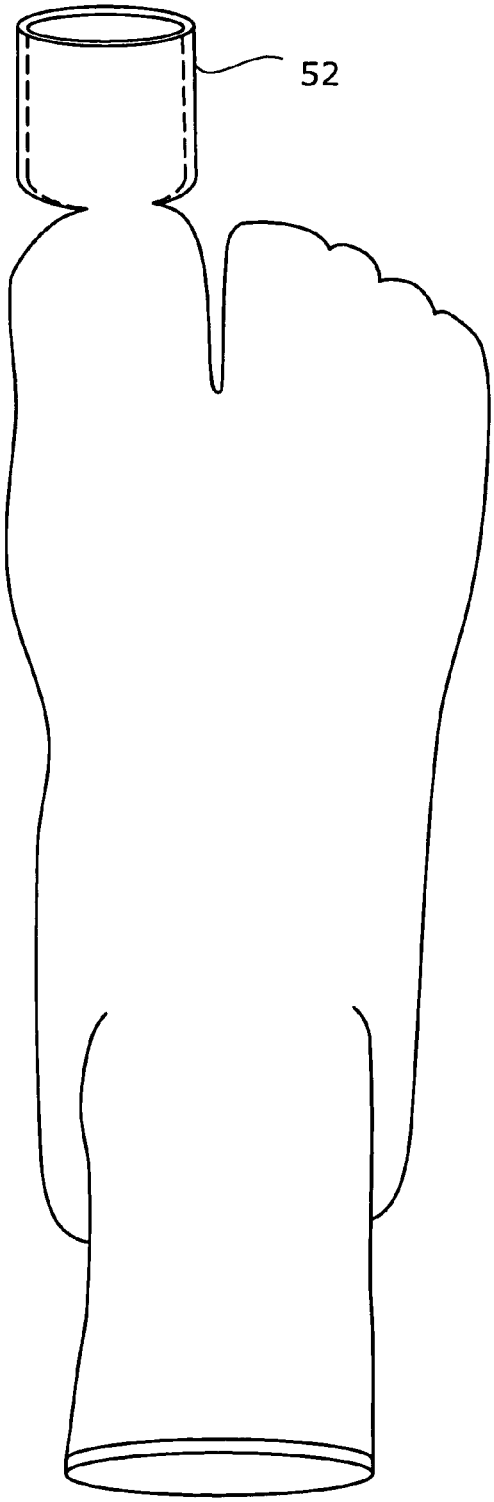
FIGS. 24 and 25 show, before an after inversion, a sleeve of large diameter which contains and cushions the great toe.
Figure 25:
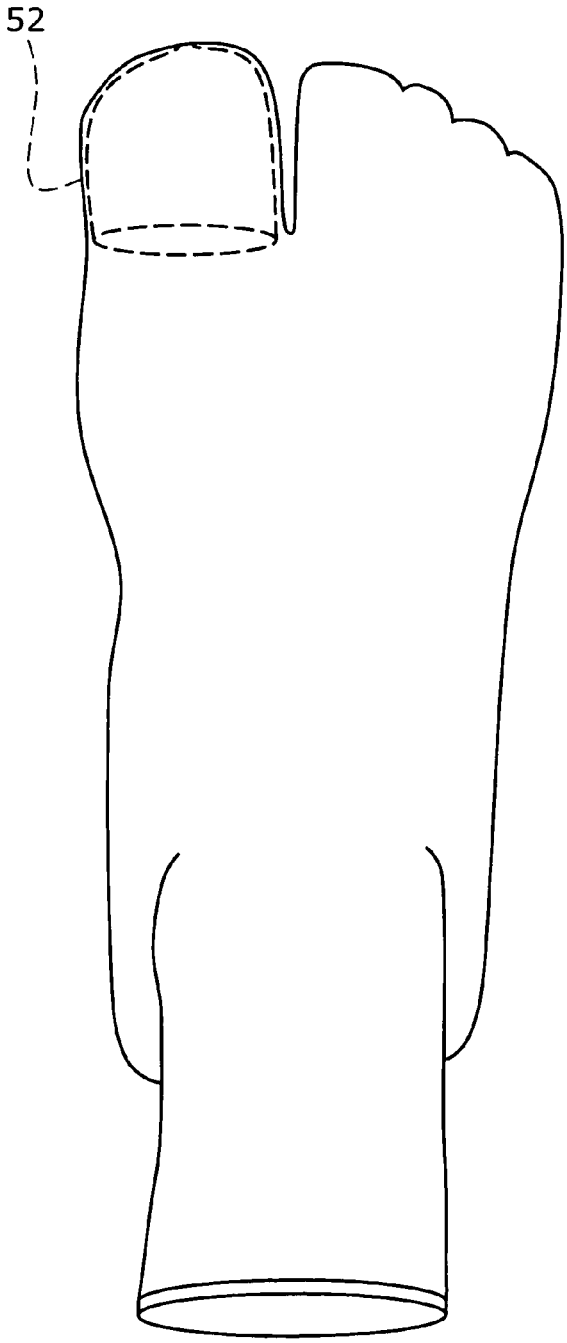

FIGS. 24 and 25 provide a large-diameter evertible tube 52 extending from the end of the great toe compartment. When the tube is everted, it surrounds and covers the top and sides of the great toe, providing comfort and protection.

The toe strap system shown in FIG. 8 may alternatively be built into a shoe, shoe insert, boot, sandal, or slipper 54, as shown in FIG. 26. The toe strap 55 loops over the big toe (protected by a toe sock or tabi sock) and is attached to an elastic strap, which passes through the wall of the shoe at 56. The strap travels down the side of the shoe just below the ankle then around the heel. It free end 58 is attached by Velcro elements 60 to the outside rear portion of the shoe, just beyond the outside of the ankle. The strap tension can be adjusted to alter the correcting force on the big toe by repositioning the Velcro elements.

FIG. 26 also shows the shoe as having a cushion 62 which repositions the foot approximately 0.25-0.38 inch (0.63-0.96 cm) toward the outside of the shoe. The slight repositioning of the foot decreases the pressure that is imposed upon the big toe by the inside wall of the shoe and also gives the toe strap (if used) greater leverage.

Each individual toe separator sock, or each toe sock with the toe strap built in, should be worn with (or contain) a foot repositioning pad, or the shoe insert with the foot repositioning pad 62 (FIG. 30) needs to be used together with these socks. A well-designed shoe, with a lot of space around the big toe or extra room in the toe box should be worn as well.

Other modifications and variations are possible. For example, up to four inter-toe spacers could be provided and up to five toe tubes could be provided, or combinations of both toe separators and toe tubes. The toe separators and toe tubes may be concealed or evident, as desired. Various materials might be used for the spacers, including rigid, resilient, and semi-rigid polymeric foam materials or a silicon gel in an envelope or integrated around a durable fabric or cloth capable of being sewn or glued for attachment purposes. The toe spacers and/or toe tubes can be permanently attached to the sock, or made to be removable. If attached, they may be secured to the sock material by sewing, adhesives, or other means.

The sock may be made of various natural or synthetic materials, such as cotton, acrylic or nylon. The nominal thicknesses of these socks may vary as well. For instance, the fabric material can be thick for an athletic sock, medium for normal socks and dress socks, or the socks can be ultra thin nylon for panty hose applications.

Within a sock, portions may vary from the nominal thickness. For example, at the toes, the sock thickness could be made approximately two-thirds the thickness of the rest of the sock. Thickness variations can be obtained simply a matter of programming the sock knitting machine.

Figure 13:
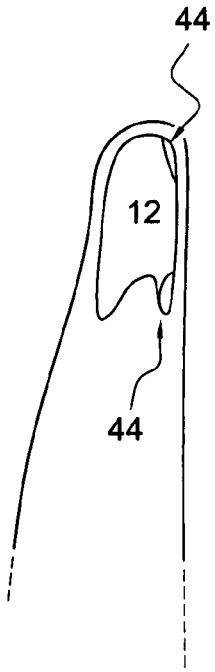
FIG. 13 is a sectional view of the toe portion of the sock shown in FIG. 12.

The socks described above can be customized for an athletic version with special toe spacers that stay in place even during strenuous foot activity (see FIGS. 12 and 13). Athletic socks can also be manufactured with an added thickness of fabric on the bottom of the foot.

Seamless glove or sock knitting machines can be modified and programmed to produce the tubular cushion pockets required for this invention, that are inverted to contain toe cushions and/or separators.

A standard sock machine should not be used to make the socks according to this invention. It is very important there be no seams at the toes, on the sides, or between the toes. Many manufacturers of tabi socks use techniques that result in thick seams between and on top of the toes, which of course is not suitable for this application. A modified hand mitten or glove sewing machine may be used instead, after modification and reprogramming. By using a hand mitten machine, toe socks can be produced having no seams between the toes.

Inasmuch as the invention is subject to these and other modifications and variations, it is intended that the invention should be mentioned not by the foregoing description and the drawings, which are only examples, but rather by the claims which follow.

The invention claimed is:

1. A sock comprising a cushion attached to the sock in a position disposed between two adjacent toes for separating the toes, and an elastic strap having a first end passing through a passage formed in the sock along the inside of the foot, said first end terminating at a loop which passes around one of the toes and the cushion so as to draw the cushion against said one toe and away from the other of said toes, said strap having a second end passing around a heel of the sock to an anchor on a portion of the sock corresponding to the outside of the foot whereby the strap tends to increase the separation between said toes.

* * * * *